United States Patent [19]

Guth

[11] 3,997,072

[45] Dec. 14, 1976

[54] COMPACTOR CONTAINER WITH REMOVABLE BOTTOM

[75] Inventor: Lauren W. Guth, Louisville, Ky.

[73] Assignee: General Electric Company, Louisville, Ky.

[22] Filed: Feb. 24, 1975

[21] Appl. No.: 552,115

[52] U.S. Cl. ..... 220/1 T; 141/390; 220/4 C; 220/65; 220/94 R; 248/101

[51] Int. Cl.[2] ..... B65D 11/18; B65D 25/14; B65D 25/32; B30B 15/00

[58] Field of Search ..... 220/1 T, 4 R, 4 A, 4 C, 220/63 R, 65, 94 R, 324, 326, 355; 248/99, 101, 346.1; 100/229 A; 141/316, 377, 390; 294/27 H, 31.2

[56] References Cited

UNITED STATES PATENTS

| | | | |
|---|---|---|---|
| 442,371 | 12/1890 | Gauntt | 141/390 X |
| 1,985,508 | 12/1934 | Lasell | 220/4 C |
| 2,690,274 | 9/1954 | Thurston | 220/236 |
| 2,740,655 | 4/1956 | Maly | 294/31.2 |
| 2,814,409 | 11/1957 | Perez | 220/4 C |
| 2,907,486 | 10/1959 | Perez | 220/4 C |
| 3,370,787 | 2/1968 | Lindholm | 232/43.2 |
| 3,405,744 | 10/1968 | Bowman | 141/12 |
| 3,528,366 | 9/1970 | Neuenberg et al. | 100/218 |
| 3,537,390 | 11/1970 | Hinkel et al. | 100/229 A X |
| 3,654,855 | 4/1972 | Longo | 100/229 A |
| 3,727,546 | 4/1973 | McKinney | 220/1 T X |
| 3,827,352 | 8/1974 | Stratman et al. | 100/229 A |
| 3,949,663 | 4/1976 | Eckerle | 220/94 R X |

*Primary Examiner*—Ro E. Hart
*Assistant Examiner*—Stephen Marcus
*Attorney, Agent, or Firm*—Francis H. Boos

[57] ABSTRACT

A refuse container assembly for use in a trash compactor, the container having a tapered sleeve and a dish-shaped bottom portion removably attached to the lower end of the sleeve by clamp means which wedges between the dish-shaped bottom portion and the sleeve. The refuse container is easily disassembled for removal of compacted refuse therefrom.

4 Claims, 4 Drawing Figures

COMPACTOR CONTAINER WITH REMOVABLE BOTTOM

BACKGROUND OF THE INVENTION

Heretofore, refuse compactors have had receptacles of parallel sidewall construction and thus suffered from the disadvantage that the compacted refuse was not easily removable from the receptacle. Provision of a flexible bag inside the receptacle, such as suggested in U.S. Pat. No. 3,827,352, has proven to be ineffectual in solving the problem since, generally, such bags are not of sufficient strength to permit lifting of compacted trash from the receptacle. The use of a support sling within a refuse receptacle has similarly proven to be ineffectual since, generally, such slings are cumbersome to use and difficult to store.

Refuse receptacles having tapered sidewalls have been suggested in U.S. Pat. Nos. 3,537,390 and 3,727,546.

In the receptacle of the '390 patent, the sidewalls are tapered to converge downwardly. Such an arrangement has the inherent defect that refuse compacted therein wedges tightly against the sidewalls and is difficult to remove.

The receptacle described in the '546 patent has sidewalls tapering divergingly downwardly. The receptacle suffers from the defect, however, that the sleeve member is, in essence, a floating sleeve and tends to rise upwardly due to the downward and outward force of refuse being compacted therein, and from the springback of the compacted refuse. In addition, the sleeve offers no means of removing the compacted refuse from the compactor itself.

Similarly, provision of an outer constant-diameter tube enclosing a sack or bag, as shown in U.S. Pat. No. 442,371, suffers from the defect that the springback of compacted refuse causes the bag, sandwiched between the refuse and the outer sleeve, to develop tears or shreds as a consequence of repeated compacting cycles. In addition, the sleeve offers no means of removing the compacted refuse from the compactor itself. Further, the shredded bag is of little help in containing the refuse after the sleeve is removed.

The invention of this application overcomes the defects of the prior art compactor receptacles and provides a simple, inexpensive, readily-constructed, and easily-maintained compactor refuse receptacle assembly.

SUMMARY OF THE INVENTION

The invention of this disclosure includes a refuse receptacle assembly for a trash compactor having a downwardly diverging, tapered, cylindrical sleeve with a clamp and bail means affixed to the smaller, upper end and a removable dish-shaped bottom portion attached to the lower end. The refuse receptacle is therefore easily removed from the compactor to enable refuse compacted therein to be transported to a disposal site and is easily disassembled, upon reaching the site, for ease of removal of the compacted refuse.

More specifically, the invention includes a refuse receptacle assembly for a trash compactor comprising: a tapered cylindrical sleeve defining the sidewall of said receptacle assembly, said sleeve having an open, smaller-diameter, first end portion and an open, larger-diameter, second end portion, said first end portion being sized to permit the passage of a compacting ram therethrough and said second end portion including compression-resistant column means integral with and parametric to said sleeve; and a removable dish-shaped bottom portion including a parametric U-shaped channel opening upwardly, one leg of said U-shaped channel being integral with the peripheral rim of said dish-shaped bottom portion, said U-shaped channel further having its free-standing leg extending upwardly beyond the rim of said dish-shaped bottom portion, said U-shaped channel also including clamp means attached adjacent said free-standing leg, said channel being sized to receive said compression-resistant column and said clamp means between its legs, said clamp means being movable between a first extended position and a second contracted position to wedgingly intercede between said free-standing leg of said U-shaped channel and said compression-resistant column to provide means for removably attaching said dish-shaped bottom portion to said sleeve.

Preferably, said clamp means comprises two members movably attached to each other, one of which is abuttable against the free-standing leg of the channel and the other engageable with the compression-resistant column of the sleeve.

Also, it is desirable that the clamp means be flexibly attached to the U-shaped channel of the dish-shaped bottom portion to allow the clamp means to swing radially outwardly beyond the outer periphery of the U-shaped channel portion to permit easy insertion of the compression-resistant column of the sleeve therein. It may be further provided that the clamp means can be placed in its contracted position while swung radially outwardly from the outer periphery of the U-shaped channel portion to prevent it from inadvertently getting in the way while the sleeve is being repositioned within the U-shaped channel member of the dish-shaped bottom portion after disposing of the compacted trash.

Advantageously, the clamp means lies within the outer periphery of the U-shaped channel portion when in its contracted, wedging position. Such an arrangement enables the receptacle to be supported in the compactor from a bracket without interference from the clamp means.

Also, it is advantageous that the clamp means include at least one leg which engages the top of the compression-resistant column of the sleeve to couple the sleeve and the dish-shaped bottom portion when in its contracted wedging position.

DESCRIPTION OF THE PREFERRED EMBODIMENT

Figure 1:
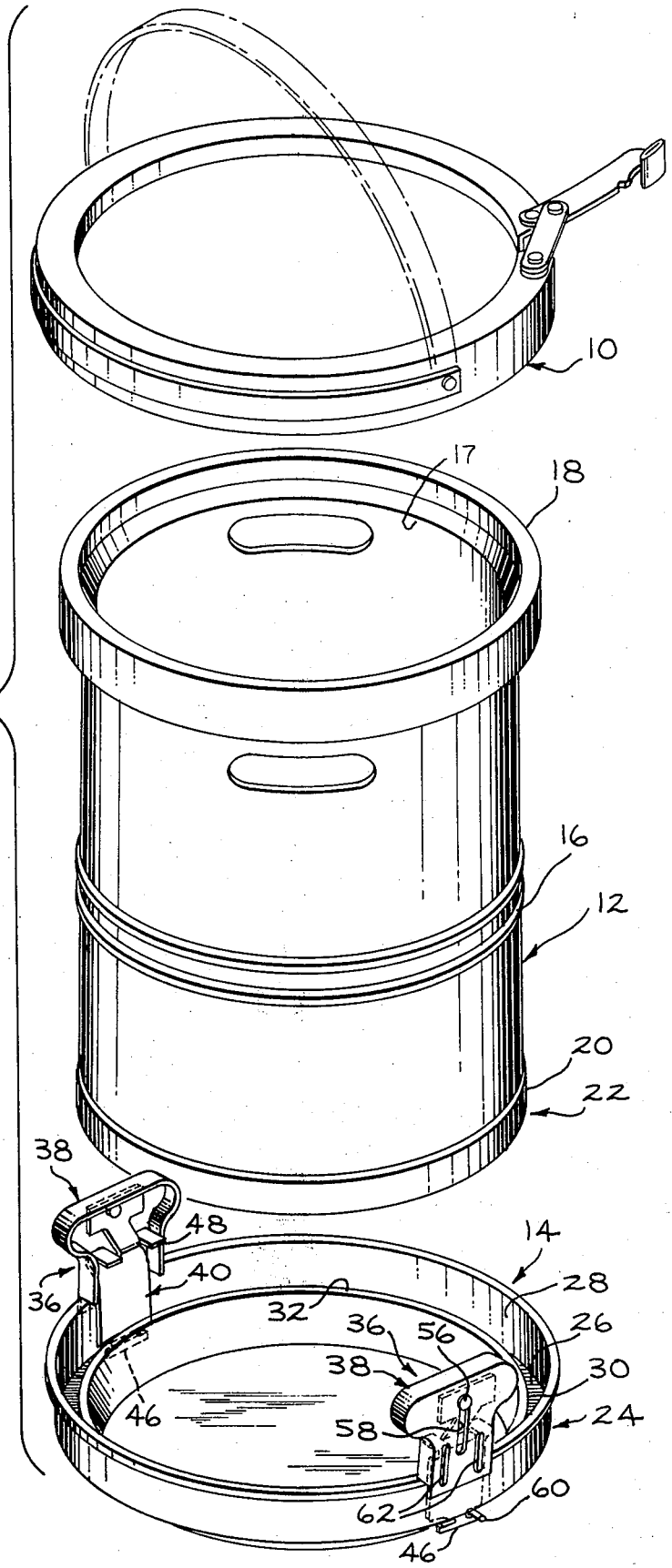
FIG. 1 is an exploded view of the refuse container of this invention.

The receptacle shown in FIG. 1 is comprised of a clamp and bail means 10, a cylindrical tapered sleeve 12, and a dish-shaped bottom portion 14. The sleeve 12 is preferably molded in one piece from a polymeric resinous material or fabricated of metal and has a slight downwardly diverging taper which allows it to be easily lifted upwardly from around compacted trash contained therein. Stiffening ribs 16 may be provided on the exterior of the sleeve 12 to increase the circumferential strength thereof. Sleeve 12 also includes an open upper end portion 18, attached to a first end portion 17 and a lower, larger-diameter end portion 22. Lower end portion 22 includes compression-resistant column means 20 integral with and parametric to sleeve 12.

The upper end portion 18 surrounds the top of sleeve 12 and is integral with first end portion 17. Upper end portion 18 gives dimensional stability to the top of the sleeve and also provides convenient means facilitating attachment of a clamp and bail means for carrying the sleeve.

The lower end portion 22 is received in channel member 24 of dish-shaped bottom portion 14 and secured in position by clamp means 36. Dish-shaped bottom portion 14 includes a U-shaped channel member 24 opening upwardly and attached around the perimeter thereof. U-shaped channel member 24 includes a bottom wall 26 and a free-standing leg 28, as well as a leg 30 integral with the peripheral rim 32 of dish-shaped bottom portion 14.

Clamp means 36 is attached to dish-shaped bottom portion 14 to serve to hold sleeve 12 thereto. Preferably, the attachment is made by inserting foot 46 through aperture 34 in bottom wall 26 of U-shaped channel member 24 and securing it with a bent wire fastening means 60 which fits into notches 44. It should be noted that the particular arrangement of foot 46 projecting through aperture 34 attaches clamp means 36 in a loose movable fashion so that the clamp means can be swung outwardly and locked, to facilitate positioning of the cylindrical sleeve 12 on the dish-shaped bottom portion 14, as shown in FIG. 1.

Figure 4:
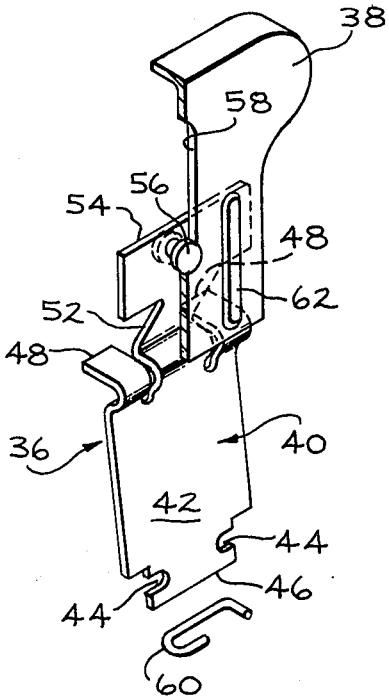
FIG. 4 is a partially exploded view showing the clamping means of this invention in its extended position.

More specifically, it can be seen that when slidable handle member 38 is in its uppermost position, as indicated in FIG. 4, it can be rotated radially outwardly from the center of dish-shaped bottom portion 14. Then, if slidable handle member 38 is moved to its contracted or lower position, it will engage the back side of free-standing leg 28 and thus be held conveniently out of the way to facilitate positioning compression-resistant column means 20 in U-shaped channel member 24 (as shown in FIG. 1).

Clamp means 36 includes a slidable handle member 38 movably attached to clamp lever 40 (FIG. 40). More specifically, clamp lever 40 includes a body portion 42 which has opposed notches 44 cut in the sides thereof adjacent a first lower end to define foot 46. At the opposite second upper end of body portion 42 are two legs 48 which engage the capital 50 of compression-resistant column means 20, as will be more fully described hereinafter. Also projecting from the second end of body portion 42 is neck 52 which terminates at head 54.

Head 54 includes pin 56 which projects through a slot 58 in slidable handle member 38 to attach the handle member to the clamp lever in movable fashion.

In operation, cylindrical tapered sleeve 12 is positioned so that the base of compression-resistant column means 20 rests on the bottom wall 26 of U-shaped channel member 24 of the dish-shaped bottom portion 14. Clamp means 36 is then swung inwardly and legs 48 of clamp lever 40 are caused to engage the capital of column 20 to secure it within the legs of U-shaped channel member 24. Slidable handle 38 is then moved downwardly to its contracted position to wedgingly intercede between free-standing leg 28 of the channel and the clamp lever to which it is attached. It should be noted that slidable handle member 38 can be provided with ribs 62 of ever-increasing height so that the act of moving slidable handle means 38 to its lowermost or contracted position causes increasing wedging pressure between leg 28 and clamp lever 40. This pressure is transmitted to column 20 causing it to abut the other leg 30 of U-shaped channel member 24. Also, the wedging forces cause legs 48 to be firmly engaged with the capital 50 of column 20. Sleeve 12 is now removably attached to bottom portion 14.

Figure 2:
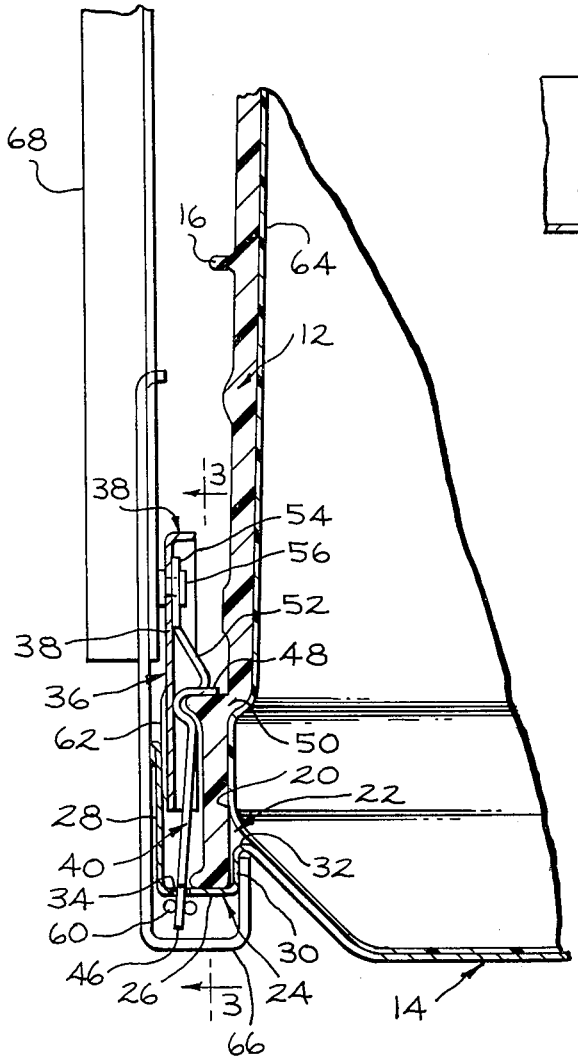
FIG. 2 is a partial elevational view in cross-section showing the clamping means attaching the sleeve of the receptacle to the dish-shaped bottom portion thereof.
Figure 3:
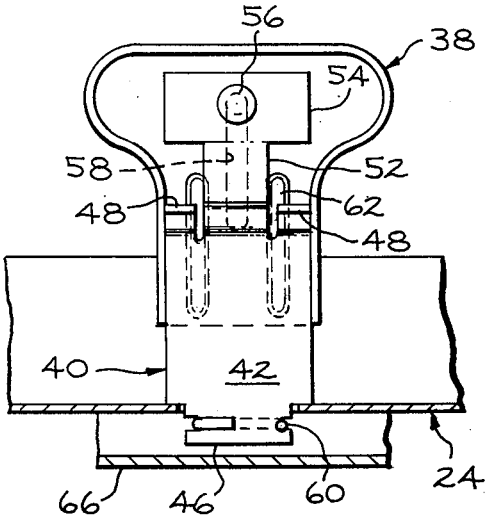
FIG. 3 is a view taken along line 3—3 of FIG. 2 showing the clamp means in its contracted wedging position.

Next, a plastic bag 64 is inserted into the receptacle with the top portion folded downwardly, overlapping upper end portion 18. A clamp and bail means 10 is then positioned on top of the receptacle with the plastic bag 64 sandwiched therebetween. The bail is then pivoted to an upright position and the refuse receptacle is carried to a compactor. The compactor door is opened and the receptacle is lowered adjacent thereto such that it can be positioned with J-shaped brackets 66 receiving U-shaped channel member 24 therein and engaging leg 30 and the underside of rim 32 (FIG. 2) to secure the lower end of the receptacle to the compactor door via standard 68. Similarly, clamp and bail means 10 is provided with attachment means (not shown) which allows it to be easily attached to the compactor door via standard 68.

The container is now ready to have refuse deposited therein and, in alternating successive operations, have the refuse compacted and additional refuse added until the container is filled with compacted refuse.

When the container is full, the door is opened and the bail is pivoted to its upright position. The container is then lifted via the bail and clamp means 10 from its mounting means on the door and is carried to a central depository or trash can. Clamp and bail means 10 is then removed from the upper end portion 18 of the tapered sleeve 12. Next, slidable handle member 38 is raised upwardly and clamp means 36 is rotated radially outwardly to disengage column 20 of sleeve 12. Slidable handle member 38 is then pushed downwardly to its contracted position to engage the back side of leg 28 and thereby hold clamp means 36 in a position where it will not interfere with the repositioning of sleeve 12 on bottom portion 14. Sleeve 12 can then be lifted upwardly, leaving a bag of compacted trash sitting on bottom portion 14. The bag of trash can then be either lifted from bottom portion 14 and be disposed of or it can be lifted, using bottom portion 14 as an under-support, whereupon the bag is merely tipped from the bottom portion 14 into the receptacle. After the refuse has been removed, the bottom portions, sleeve, and clamp and bail means are then reassembled and repositioned in the compactor for subsequent use.

It can be seen that in employing this invention it is not necessary to use a plastic bag liner in the container. If such a bag is not used, clamp and bail means 10 need not be removed each time the receptacle is emptied, but, rather, the receptacle can be rested with its sidewall on the edge of the trash can and the bottom portion released and taken away to allow the compacted trash to slide from sleeve 12 directly into the can. The bottom portion is then repositioned on sleeve 12 and the receptacle is returned to the compactor for further use.

Having thus described the invention, what is claimed is:

1. A refuse receptacle assembly for a trash compactor comprising:

a tapered cylindrical sleeve defining the side wall of said receptacle assembly, said sleeve having an open, smaller-diameter, first end portion, and an open, larger-diameter, second end portion, said first end portion being sized to permit the passage of a compacting ram therethrough and said second end portion including compression-resistant column means integral with and parametric to said sleeve; and a removable dish-shaped bottom portion including a parametric U-shaped channel, opening upwardly, one leg of said U-shaped channel being integral with the peripheral rim of said dish-shaped bottom portion, said U-shaped channel further having its free-standing leg extending upwardly beyond the rim of said dish-shaped bottom portion, said U-shaped channel also including clamp means attached adjacent said free-standing leg, said channel being sized to receive said compression-resistant column and said clamp means between its legs, said clamp means being movable between a first extended position and a second contracted position to wedgingly intercede between said free-standing leg of said U-shaped channel, said clamp means being further defined as including two members attached and movable with respect to each other, one of which is abuttable against said free-standing leg of said channel and the other engageable with said compression-resistant column of said sleeve and wherein said clamp means is flexibly attached to said U-shaped channel of said dish-shaped bottom portion to allow said clamp means to swing radially outwardly beyond the outer periphery of said U-shaped channel portion to permit easy placement of said compression-resistant column of said sleeve therein and to provide means for removably attaching said dish-shaped bottom portion to said sleeve.

2. The refuse receptacle assembly of claim 1 wherein said clamp means lies within the outer periphery of said U-shaped channel portion when in its contracted wedging position.

3. The refuse receptacle assembly of claim 1 wherein said clamp means includes at least one leg engaging the top of said compression-resistant column, when in its contracted wedging position, to couple said sleeve and said dish-shaped bottom portion.

4. The refuse receptacle assembly of claim 1, wherein said sleeve includes an upper end portion integrally attached to and surrounding the first end portion of said sleeve and wherein a bail is attached to said upper end portion to facilitate lifting of said assembly.

* * * * *